United States Patent [19]

Winslow, Jr.

[11] 4,049,535

[45] Sept. 20, 1977

[54] ELECTRICAL TREATER WITH A.C-D.C. ELECTRICAL FIELDS

[75] Inventor: Joseph D. Winslow, Jr., Houston, Tex.

[73] Assignee: Petrolite Corporation, St. Louis, Mo.

[21] Appl. No.: 643,224

[22] Filed: Dec. 22, 1975

[51] Int. Cl.[2] ..... C10G 33/02

[52] U.S. Cl. ..... 204/305

[58] Field of Search ..... 204/305, 191

[56] References Cited

U.S. PATENT DOCUMENTS

| | | | |
|---|---|---|---|
| 1,978,426 | 10/1934 | Hahn | 204/305 X |
| 2,849,395 | 8/1958 | Wintermute | 204/305 |
| 3,252,884 | 5/1966 | Martin et al. | 204/302 |
| 3,772,180 | 11/1973 | Prestridge | 204/305 |
| 3,847,775 | 11/1974 | Prestridge | 204/191 |
| 3,939,395 | 2/1976 | Prestridge et al. | 323/4 |

FOREIGN PATENT DOCUMENTS

| | | | |
|---|---|---|---|
| 450,934 | 7/1936 | United Kingdom | 204/305 |

*Primary Examiner*—John H. Mack
*Assistant Examiner*—Aaron Weisstuch
*Attorney, Agent, or Firm*—Sidney B. Ring; Hyman F. Glass

[57] ABSTRACT

An electrical field treater for resolving an emulsion formed of a continuous oil phase containing a dispersed water phase with grading a.c.-d.c. electric fields. The treater comprises a metal vessel having an emulsion inlet and outlets to remove the purified oil phase and a coalesced water phase. Insulated electrode sets are energized by an external power source to regulated d.c. potentials between the electrodes and earth ground, and an a.c. current component between the electrodes and earth ground. The earth ground may be a metal electrode or a body of water maintained in the vessel.

12 Claims, 4 Drawing Figures

ELECTRICAL TREATER WITH A.C-D.C. ELECTRICAL FIELDS

BACKGROUND OF THE INVENTION

1. Field of the Invention

This invention relates to the resolving of emulsions having a continuous oil phase containing a dispersed water phase. More particularly, the present invention relates to electrical field treatment for resolving water-in-oil emulsions.

2. Description of the Prior Art

Electrical field treaters have been employed to resolve emulsions for nearly 70 years. These emulsions have a continuous oil phase, which terminology includes the various hydrocarbons such as crude oil, petroleum distillates and residuum derived during refining and other hydrocarbon processing. Also included in this terminology are various organic liquid materials which are water immiscible, have a relative low electrical conductivity and a low dielectric constant compared to water. The dispersed water phase may be water, brine, or other aqueous material such as acids or caustics. When the continuous phase is crude oil, the treater usually employs an a.c. electric field for resolving the emulsion. A d.c electric field is preferable for resolving the dispersion where the continuous oil phase is a distillate and the dispersed water phase is an acid or caustic. In other instances, it is desired to first apply an a.c. electric field to the emulsion, and then, subjecting the emulsion to a d.c. electric field to complete the treatment. Reference may be taken to U.S. Pat. No. 2,855,356 wherein there is described such a combination a.c.-d.c. electrical field treater for resolving an emulsion formed of distillate and an aqueous treating material. More particularly, the electrical field treater is arranged for vertical flow of the emulsion and employs two sets of electrodes. The upstream set of electrodes is energized by an a.c. potential and the downstream set of electrodes is energized by d.c. potential. In addition, these a.c.-d.c. electric fields are arranged to provide potential gradients which change from non-uniform to uniform character in the direction of emulsion flow. In this treater, each set of electrodes has one electrode energized and the other electrode referenced to ground for defining the electric field. A subsequent improvement is illustrated in U.S. Pat. No. 2,897,251 employing a dual output d.c. power source to provide two separate d.c. potentials for energizing separate insulated sets of electrodes, one electrode in each set being referenced to ground. A related combination of a.c.-d.c. electrical field treater is shown in U.S. Pat. No. 2,849,395. In this reference, a dual zone electrical field treater has an upstream a.c. electric field zone with a following downstream d.c. electric field zone for treating emulsions. In particular, the d.c. zone employs a novel arrangement of planar, vertically-oriented, metal electrode sets, all of which are insulated from the metal vessel and energized through separate entrance bushings from an external power source. The external d.c. power source has a full wave or half wave rectifier for producing the desired d.c. electric field. In this instance, both electrodes are energized relative to earth ground at a first potential gradient, and the sets of electrodes are energized at a second potential relative to one another.

In the foregoing references, it is noted that the a.c. electric field and the d.c. electric fields for the combined a.c.-d.c. electrical field treaters were provided separately by an a.c. power source and a d.c. power source. However, it has been proposed to employ a single power source with an electrical field treater to energize simultaneously sets of electrodes to a.c. and d.c. electric fields for emulsion resolution. In U.S. Pat. No. 2,849,395, there is shown an electrical field treater for resolving an emulsion into a treated oil phase and a coalesced water phase using a.c.-d.c. electric fields. Parallel, vertical metal plates are arranged within a metal vessel with one set of electrodes positioned upstream for energization by an a.c. voltage and a downstream set of electrodes energized by a d.c. voltage, which preferably is pulsed. The metal vessel forms a subtended grounded electrode beneath these electrode sets. As a result, the grounded electrode (and any water layer) of the vessel serves as a circuit common to both a.c. and d.c. voltages. The power source provides simultaneously both d.c. and a.c. potentials on the electrodes relative to earth ground. The potential gradient (a.c. and d.c.) between electrodes in the upstream and downstream sets is uniform between adjacent electrodes in each set and also relative to the metal vessel which forms the circuit common reference.

Attempts have been made to provide a common a.c.-d.c. power source for energizing separate insulated electrode sets with an a.c. voltage component on electrodes upstream of the electrodes energized with a d.c. voltage. For example, U.S. Pat. Nos. 3,772,180 and 3,847,775 illustrate an electrical field treater with a power source described as providing combined a.c.-d.c. potentials for energizing an insulated set of electrodes. The power source has a high voltage secondary winding with one terminal at earth ground and the other terminal common to both electrode sets through half wave rectifiers. If the current flow to the electrodes is of similar magnitudes, the system theoretically would be operable. However, a slight unbalance in the current consumed by either electrode causes current within the secondary winding of the transformer. Obviously, a d.c. current in the secondary winding of the transformer causes magetization of the transformer core leading to increase in the primary current. This in turn will lead to saturation of the current regulator preceding the transformer, and the primary overcurrent protection means will most likely disconnect the power source from the main supply. Thus, unbalance between the current passed by the rectifiers to their respective loads will result in the necessity of disconnecting the source from the main supply or require that components for regulation and transformation be substantially underrated with respect to the normal treater loads.

The full wave and half wave rectifying system employed in conventional power supplies has basically the same problem as in the aforementioned patents. Particularly, an unbalance in current consumption at the output terminals causes an unbalanced a.c. component to be passed through one of the rectifiers. This a.c. component appears as a d.c. current in the secondary winding to magnetize the core of the transformer and results in greater losses within the transformer, and leads to saturation of conventional current limiting reactors. The electrical field treater of the present invention provides a novel power supply which is capable of producing simultaneous energization of an insulated set of electrodes with both a.c. and d.c. voltage components wherein the d.c. components are regulated at a first potential between the electrodes and at a second potential relative to earth grounds in the treater. In addition, either electrode can consume more current than the other, creating a substantially severe current unbalance and not magnetizing the transformer employed in the power source. In addition, the magnitude of the a.c. component present between the sets of electrodes and earth grounds is arranged to a selected value.

It is usual to employ current limiting reactors in the primary circuits of electric treater power sources. The transformers normally employed for full wave rectification must be derated to approximately 35% output current rating when supplying loads at half wave rectified d.c. The danger is that the regulator means will be set to protect the transformer assuming balanced secondary operation, thus leaping to excessive (×3) overload operation should one of the half wave d.c. load fields collapse in the treater due to insulation failure or increases in localized demand.

SUMMARY OF THE INVENTION

In accordance with the present invention, there is provided an electrical field treater for resolving water-in-oil emulsions by grading a.c.-d.c. electrical fields. The treater system includes a vessel having an emulsion inlet, an oil phase outlet and a water phase outlet. Electrodes are mounted within the vessel in the flow path of fluid moving between the inlet and oil phase outlet. The electrodes, which include first and second sets, are insulated from the vessel and adapted for simultaneous energization by an external power source to d.c. potentials relative to each other and earth ground, and to a.c. potential components above earth ground for resolving the emulsion into a treated oil phase and a coalesced water phase. The external power source includes a power transformer connectable to an a.c. source of current for providing elevated a.c. potentials at end terminals of a secondary winding in electrical isolation to the a.c. source of current and earth ground. In addition, the secondary winding has a center tap connected to earth ground and rectifiers forming a floating, full wave bridge which is connected at opposite arm junctions to the end terminals of the secondary winding and at the remaining arm junctions connected as positive and negative d.c. source terminals to the first and second sets of electrodes, respectively. A grounded electrode is disposed in spaced relationship from the first and second sets of electrodes. A body of treated oil is maintained about the first and second sets of electrodes by a control means, and this body of oil extends towards the grounded electrode. As a result, emulsion entering the vessel is subjected to grading a.c.-d.c. electrical fields during resolution and substantial unbalance of d.c. current consumption in the first and second sets of electrodes fails to disrupt the a.c.-d.c. electric fields.

DESCRIPTION OF SPECIFIC EMBODIMENTS

Figure 1:
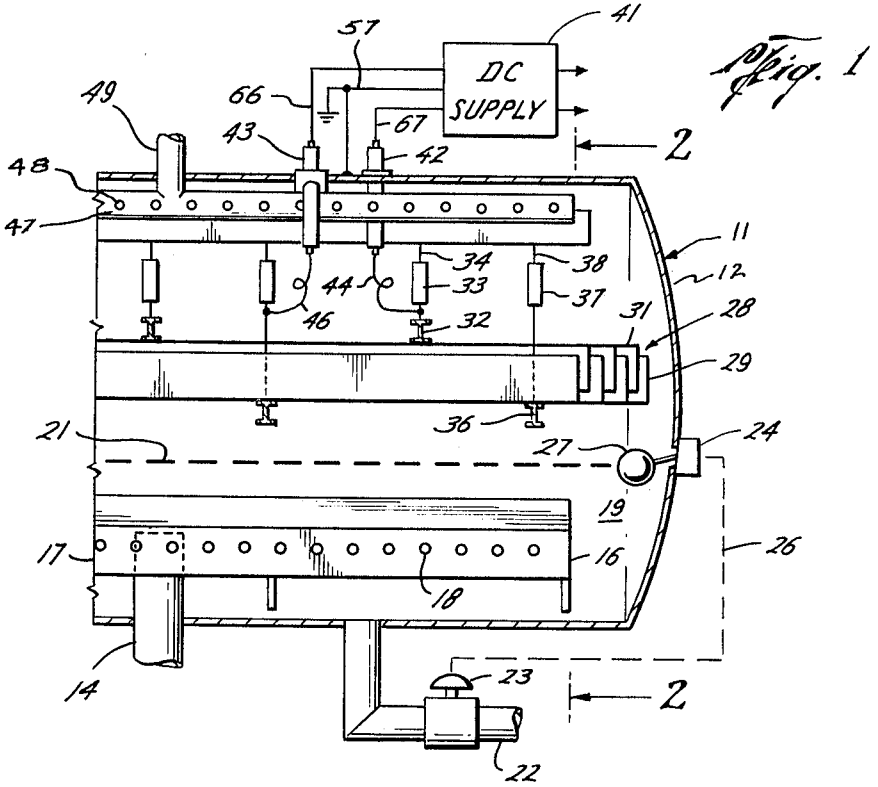
FIG. 1 is a partial vertical longitudinal section taken through an electrical field treater connected to a power source arranged according to one embodiment of the present invention.
Figure 2:
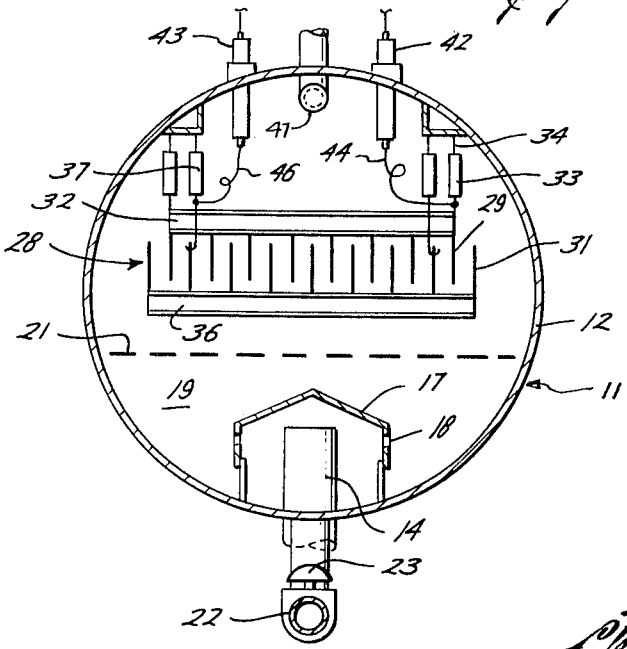
FIG. 2 is a cross-section of the treater taken along line 2—2 of FIG. 1.

Referring now to FIGS. 1 and 2, there is an illustration of an electrial field treater 11 which includes a pressure vessel 12 having metal sidewalls and ends. The vessel may be cylindrical with exterior insulation (not shown) and disposed with its longitudinal axis in the horizontal. The treater 11 receives an emulsion through a pipe 14 into a distributor 16 which has a longitudinal section 17 carrying a plurality of openings 18. Preferably the distributor 16 is arranged in accordance with U.S. Pat. No. 3,458,429. The emulsion should be uniformly discharged from the openings 18 into the vessel 12. The dispersion passes upwardly through a body of water 19 which is maintained within the lower portion of the vessel 12. Then, the emulsion emerges from the interface 21 and moves into the a.c.-d.c. electric field established by electrode sets 28 carried about the midline of the vessel 12. The interface 21 of the body of water 19 is held at a suitable horizon by the regulated withdrawal of water through an outlet 22 in which flow is controlled by a motor valve 23. The motor valve 23 is actuated by controller 24 through an inner connection indicated by chain line 26. The controller 24 is operated by a float 27 which monitors the horizon at which the interface 21 resides within the vessel 12.

The electrode sets 28 are energized by a power source to produce an electric field with a.c. voltage components between the interface 21 and these electrode sets, and additionally, an electric field with d.c. voltage components between these electrode sets and the vessel 12 or other adjacent earth ground. As a result, the emulsion is subjected to grading a.c.-d.c. electric fields in succession, and at non-uniform and uniform voltage gradients for resolution into the purified oil phase and coalesced water phase. The electrode sets 28 may take any suitable form but preferably are arranged by mounting rigid planar metal electrodes 29 and 31 in a vertical orientation and aligned lengthwise parallel to the longitudinal axis of the vessel 12. More particularly, the electrodes 29 and 31 can be equally spaced, longitudinally extending strips of metal equal in surface area disposed at substantially the middle line of the vessel 12. The electrode sets 28 and 29 may thus have substantially the same surface area exposed for current flow to fluid within the vessel 12. The electrdes 29 are supported from transverse "I" beams 32 which are suspended from the vessel 12 by insulators 33 and support rods 34. The electrodes 31 are mounted upon "I" beams 36 which are suspended by insulators 37 from support rods 38 connected to the vessel 12. The electrodes 29 have bottom edges below electrodes 31 (as seen in FIG. 2), but both electrodes are arranged separately for energization from a power source 41 carried externally of the vessel 12. For this purpose, entrance bushings 42 and 43 are provided through the sidewall of the vessel 12 with their lower terminals connected by leads 44 and 46, respectively, to electrodes 29 and 31. Externally of the vessel 12, the bushings 42 and 43 connect respectively to the positive and negative d.c. potential terminals of the power source 41. The earth ground 57 is connected between the power source 41 and the metal sidewall of the vessel 12 to provide a "ground" reference for the electrical system of the treater 11.

Energization of the electrodes 29 and 31 provides the a.c.-d.c. combination electric fields for resolving the emulsion introduced through the pipe 14. The coalesced water phase falls through the interface 21 and merges into the body of water 19. The treated oil phase passes upwardly and is gathered into the collector 47 through the openings 48 and then it is moved through an oil outlet pipe 49 from the vessel 12 to a suitable utilization.

Figure 3:
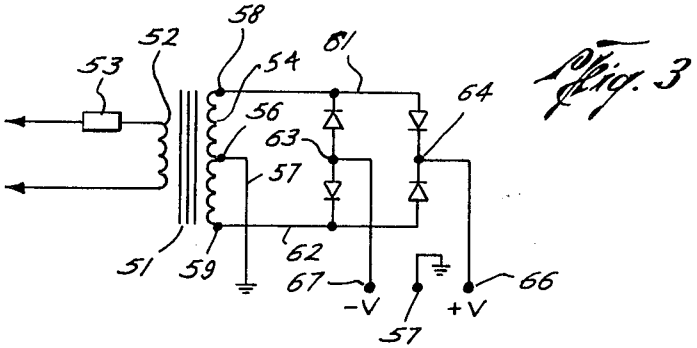
FIG. 3 is an electrical diagram illustrating the basic elements of the power source shown in FIG. 1.

Refer to FIG. 3 for an illustration of the basic configuration for the power source 41 employed with the present invention. A step-up transformer 51 has a center tap 56 connected to earth ground 57 for reference purposes. The end terminals 58 and 59 of the secondary 54 are connected to a full wave rectifier bridge. The transformer 51 has a primary 52 connected through a control circuit 53 to suitable a.c. current sources which may be a 220/440 volt circuit. The rectifier bridge is floating relative to earth ground and connects at opposite arm junctions 61 and 62 to terminals 58 and 59, respectively. The remaining arm junctions 63 and 64 connect to the positive and negative d.c. source terminals 66 and 67 of the power source 41. The filtering capacitors of the d.c supply source 41 have been omitted from FIG. 3 to simplify the present description. It will be apparent that the positive d.c. potential is present as a first voltage between terminals 57 and 66. A second voltage of equal magnitude but of negative polarity is present between terminals 57 and 67. Thus, the positive and negative potentials relative to earth ground 57 (at low current demands) are essentially one-half of the a.c. potential appearing between terminals 58 and 59 of the secondary 54. However, the full potential of the secondary 54 between the terminals 58 and 59 appears as the d.c. potential component between the terminals 66 and 67. A current unbalance in either the positive or negative terminal of the power source 41 will return the resulting a.c. component through the other arm of the rectifier bridge into the secondary 54 between one of terminals 58 or 59, and earth ground 57 (terminal 56). For example, should the terminal 66 pass more current than the terminal 67, an a.c. component is returned into the secondary 54 between the terminals 56 and 59 to exactly balance the current demand of the secondary 54 between terminals 56 and 58. As a result, no d.c. current components can appear in the secondary 54 of the transformer 51. Thus, either of the d.c. potential output terminals 66 and 67 can provide a separate d.c. potential and current flow relative to ground 57 and the secondary 54 is immune from the deleterious effects of unbalance current consumption in the treater 11. In accordance with the present invention, the power source 41 is arranged so that there is an a.c. component which also is present between the terminals 66 and 67 relative to earth ground 57.

Figure 4:
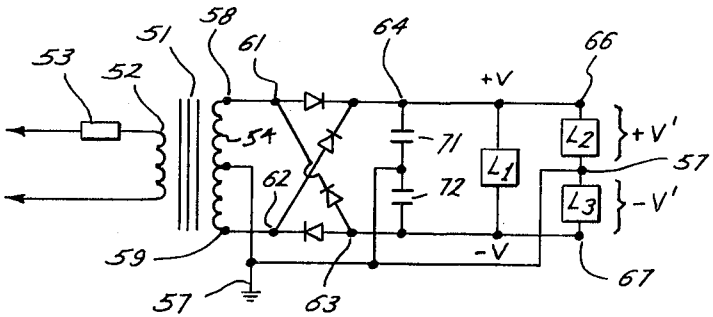
FIG. 4 is an electrical diagram illustrating the preferred embodiment of the power source of FIG. 2.

In reference to FIG. 4, the preferred embodiment of power source 41 of FIG. 3 is illustrated with like components bearing like numerals. The floating full wave rectifier bridge has been redrawn to illustrate graphically the return path of a.c. potential components when an unbalance in current appears at the output terminals 66 and 67 relative to earth ground 57. The terminals 66 and 67 connect to the electrodes 29 and 31, respectively. The electrodes 29 have a current demand indicated as load $L_2$; the electrodes 31 have a current demand indicated as load $L_3$; both loads being relative to earth ground 57. The current demand (a.c. and d.c.) between the electrodes 29 and 31 is indicated as load $L_1$. The load $L_1$ is energized by d.c. potentials $+V$ and $-V$, and the loads $L_2$ and $L_3$ by $+V'$ and $-V'$respectively.

It will be apparent that the voltages $+V'$ and $-V'$ are both referenced between the terminals 66 and 67 relative to ground 57. However, the load $L_1$ present between the electrodes 29 and 31 is referenced only between the terminals 66 and 67. As a result, the loads, $L_1$, $L_2$, and $L_3$, can have different potential magnitudes and different current demands, as long as the total current consumption is within the capabilities of the transformer 51. Irrespective of these different d.c. potentials applied to these various loads, they can have different current demands. The function of the full wave floating bridge and center tapped secondary 54 of the transformer 51 permits a.c. components arising from unbalanced current demands to be returned through respective rectifers of the bridge so that the current flow within the secondary 54, to each side of the center tap 56, remains balanced and free of d.c. current components.

The result is that any of all loads may be dropped, shorted and/or combined without the need to consider what the effect might be on rating, disipation and/or magnetization of the power source or supply components. This system also exhibits 100% utility in the respect that process upsets which lead to collapse of the fields within the treater can be sought out and corrected while maintaining power system continuity and preparedness for "picking up" the load when restored to normal value.

In addition, the power source 41 provides a certain magnitude of a.c. potential components between the electrode sets 28 and earth ground 57 or the interface 21 as the grounded electrode. For this purpose, capacitors 71 and 72 are placed between the terminals 66 and 67 and earth ground 57 at the arm junctions 63 and 64 of the full wave bridge rectifiers. These capacitors are selected to have reactances inducing a certain magnitude of "ripple" in the d.c. voltage $+V$ and $-V$ according to conventional design criterions. The transformer 51 operates generally from 60 Hz a.c. power sources so that the output voltage at arm junctions 63 and 64 has a ripple frequency of 120 Hz. The capacitors are selected so that a certain "ripple" is obtained which is the Rms value of the a.c. potential component relative to the total d.c. output across load $L_1$. For example, these capacitors are selected so that there is at least about a 5% ripple in the d.c. current at the terminals 66 and 67. Thus, if the d.c. potential between the terminals 66 and 67 is 50 kv d.c., then the a.c. component between these terminals relative to earth ground will be 2.5 kv. As a result, the a.c. potential field of 2.5 kv is applied between the electrode sets 28 and the interface 21 or other related "grounded" electrode inerposed between the electodes and the incoming emulsion, i.e., upstream from said electrode sets 28, relative to the direction of flow of the emulsion. Preferably, this grounded electrode structure is horizontal relative to the vessel 12.

It will be apparent that the power source 41 provides a unique energization of the electrical field treater 11. If desired, the electrodes 29 and 31 may be energized to the same d.c. potential, one being negative and one being positive, relative to earth ground. Alternatively, the d.c. potentials of energization of these electrodes may be adjusted to a different magnitude or so that both electrodes consume identical current. Thus, the operator of the electrical field treater 11 may determine whether he wants to treat by uniform potential gradients or uniform current demand in the d.c. field between the electrodes 29 and 31 and also to earth ground 57.

In summary, the power source 41 permits insulated electrodes to be selectively energized to positive and negative d.c. potentials of selected magnitudes and current demands, whether equal or different, and to provide an a.c. potential component between the electrodes and ground. Also, the transformer 51 may be used at its full rated current capacity even if current demands by the loads are varied. Thus, the d.c. potential and current demand of each of electrodes 29 or 31 is separate and apart from the other, and the a.c. component can be selected irrespective of the d.c. potentials and current demands. A single power source provides a plurality of d.c. potentials and currents, and a.c. potential components and currents, separately from one another without interference, and without any danger of a current unbalance destroying the utility of the power source 41.

From the foregoing, it will be apparent that there has been provided a novel electric field treater employing a single unitary supply source capable of energizing electrodes with both d.c. and a.c. potentials and unbalanced currents in a manner not previously found in the arts. Various changes and modifications may be made to the structure of the present electric field treater without departing from the spirit of the invention. It is intended that the present description be taken in illustration of the present invention, the appended claims define the scope of the present invention.

What is claimed is:

1. An electrical treater system for resolving water-in-oil emulsion by grading a.c.-d.c. electrical fields, comprising:

a. vessel means having emulsion inlet means, and oil phase and water phase outlet means;

b. electrode means mounted within said vessel means arranged to be in the flow path of fluid moving between said emulsion inlet means and oil phase outlet means, and said electrode means including first and second sets of electrodes insulated from said vessel means and adapted for simultaneous energization by an external power source to d.c. potentials relative to each other and a.c. potential components above ground for resolving the emulsion into a treated oil phase and a coalesced water phase;

c. said external power source including power transformer means connectable to an a.c. source of current for providing elevated a.c. potentials at end terminals of a secondary in electrical isolation to the a.c. source of current and earth ground, and said secondary having a center tap connected to earth ground with a floating full wave rectifier bridge connected at opposite arm junctions to the end terminals of said secondary and at the remaining arm junctions as positive and negative d.c. source terminals to said first and second sets of electrodes, respectively;

d. said electrode means including a grounded electrode disposed in spaced relations to said first and second sets of electrodes and arranged to be upstream from said sets of electrodes relative to the direction of flow of the emulsion; and e. control means for maintaining a body of treated oil phase about said first and second sets of electrodes and extending toward said grounded electrode, whereby emulsion within said vessel means is subjected to grading a.c.-d.c. electrical fields during resolution and substantial unbalance in d.c. current demand in said first and second sets of electrodes fails to disrupt the a.c.-d.c. electrical fields.

2. The electrical treater system of claim 1 wherein said grounded electrode is disposed horizontally within said vessel means.

3. The electrical treater system of claim 1 wherein said control means for maintaining said body of treated oil phase is adapted to provide an oil phase-water phase interface as said grounded electrode.

4. The electrical treater system of claim 1 wherein said first and second sets of electrodes are provided by at least a pair of parallel rigid planar metal electrodes mounted vertically in said vessel means.

5. The electrical treater system of claim 1 wherein said first and second sets of electrodes have substantially the same surface area exposed for current flow to fluid within said vessel means.

6. The electrical treater system of claim 1 wherein said first and second sets of electrodes are provided by a plurality of equally-spaced parallel straight metal plates mounted vertically in a supporting framework suspended by insulators within said vessel means, and said plates are positioned alternately between said first and second sets of electrodes whereby uniform gradient d.c. electrical fields exist between adjacent plates and nonuniform a.c.-d.c. electrical fields exist between the edges of said plates and said grounded electrode.

7. The electrical treater system of claim 1 wherein said full wave rectifier bridge outputs to said positive and negative potential terminals have separately adjustable voltage capabilities whereby d.c. current unbalance in demand between said first and second sets of electrodes and earth ground can occur without effecting changes in elevated d.c. potentials applied thereto.

8. The electrical treater system of claim 7 wherein d.c. potentials applied to said first and second sets of electrodes can be selected independently from the total d.c. potential applied between said first and second sets of electrodes.

9. An electrical treater system for resolving water-in-oil emulsion by grading a.c.-d.c. electrical fields, comprising:

a. vessel means having emulsion inlet means, oil phase outlet means and water phase outlet means;

b. electrode means mounted within said vessel means including first and second sets of electrodes insulated from said vessel means and ground, and a grounded electrode disposed in spaced relationship to said sets of electrodes and arranged to be upstream from said sets of electrodes relative to the direction of flow of the emulsion;

c. said first and second sets of electrodes provided with electrical bushing means and conductors for simultaneous energization by an external power source to elevated d.c. potentials; and d. an external power source providing elevated d.c. potentials to said first and second sets of electrodes at substantially the same potential magnitude relative to ground but opposite in d.c. polarity, and also providing at least about a 5% ripple in the d.c. current between said first and second sets of electrodes and an a.c. voltage component between said sets of electrodes and ground, said a.c. voltage component being a percentage of the d.c. voltage between said first and second sets of electrodes, said percentage being the same as the percent of ripple in said d.c. voltage; whereby emulsion within said vessel means is subjected to grading a.c.-d.c. electrical fields during resolution and substantial unbalance in d.c. current demands in said first and second sets of electrodes fails to disrupt the a.c.-d.c. electrical fields.

10. The electrical treater system of claim 9 wherein said d.c. power source includes a power transformer means energized by a.c. current and having elevated a.c. potentials at end terminals of a secondary in electrical isolation to the a.c. source of current and earth ground, rectifier means comprising a floating full wave bridge circuit connected at opposite arm junctions to the end terminals of said secondary and at the remaining arm junctions as positive and negative d.c. source terminals to said first and second sets of electrodes, respectively.

11. The electrical treater system of claim 10 wherein said secondary has a grounded center tap wherein said full wave bridge outputs to said positive and negative potentials have separate voltage capabilities whereby d.c. current unbalance between said first and second sets of electrodes and earth ground produces no simultaneous change in elevated d.c. potentials applied thereto.

12. The electrical treater system of claim 10 wherein d.c. potentials applied in said first and second sets of electrodes can be regulated independently from the total d.c. potential applied between said first and second sets of electrodes.

* * * * *